United States Patent [19]

Winesett

[11] Patent Number: 4,630,310

[45] Date of Patent: Dec. 16, 1986

[54] OFF-SET MEANS FOR REMOVING BAGS FROM CONNECTED PLURAL ROWS

[76] Inventor: Franklin P. Winesett, P.O. Box 999, San Andreas, Calif. 95249

[21] Appl. No.: 707,389

[22] Filed: Mar. 1, 1985

[51] Int. Cl.[4] ..... B65D 30/00

[52] U.S. Cl. ..... 383/37; 206/870; 383/87; 493/194; 493/224; 493/230; 493/238

[58] Field of Search ..... 383/37, 87, 84, 10; 206/820; 493/196, 198, 220, 224, 230, 233, 238, 194; 229/69, DIG. 9

[56] References Cited

U.S. PATENT DOCUMENTS

| | | | |
|---|---|---|---|
| 2,709,467 | 5/1955 | Hoeppner | 383/87 |
| 2,929,180 | 3/1960 | Abrams et al. | 383/87 X |
| 3,015,918 | 1/1962 | Sclioen | 383/87 X |
| 3,060,075 | 10/1962 | Kincaid | 383/37 X |
| 3,363,828 | 1/1968 | Foglia et al. | 383/37 X |
| 3,411,698 | 11/1968 | Reynolds | 229/69 |
| 3,454,441 | 7/1969 | Spruyt | 383/10 X |
| 3,626,821 | 12/1971 | Gendron | 229/69 |
| 3,762,542 | 10/1973 | Grimes | 383/37 X |
| 3,774,837 | 11/1973 | Franson | 383/17 X |
| 3,935,810 | 2/1976 | Milano | 383/37 X |
| 3,960,314 | 6/1976 | Faiers | 383/87 |
| 4,164,170 | 8/1979 | Nordin | 493/194 |
| 4,337,058 | 6/1982 | Lerner | 493/198 X |
| 4,344,557 | 8/1982 | Lerner | 383/37 |

*Primary Examiner*—William Price
*Assistant Examiner*—Bryon Gehman
*Attorney, Agent, or Firm*—Leonard Bloom

[57] ABSTRACT

A series of bags comprising at least two rows in side by side relationship is disclosed. Each row comprises a plurality of bags separable from the next by perforations between the bottom seal of one bag and the top lip of an adjacent bag. The rows are staggered such that the perforations do not extend entirely across the rows.

1 Claim, 7 Drawing Figures

OFF-SET MEANS FOR REMOVING BAGS FROM CONNECTED PLURAL ROWS

BACKGROUND OF THE INVENTION

The following invention relates generally to a method and apparatus for forming bags, preferably out of thermoplastic, films or laminates, but not limited to plastics, and the resultant article formed thereby.

More specifically, the invention embraces an instrumentality for forming bags which when fabricated include a pocket within which articles to be stored are disposed, the pocket including a turned down flap on a leading edge of the opening tacked into place on a surface of the bag. This doubled over portion allows a conventional purchase area to effect expeditious and facile opening of the bag and a corresponding area on another surface of the bag not folded over forms a lip type structure which can selectively occlude the opening.

There are bags commercially available which include a folded over portion or flap and an associated lip adapted to close an interior portion of the bag. These bags, commonly marked under the name Baggies TM are currently being manufactured with the opening of the bag parallel to the direction of travel of indeterminate length sheets of plastic materials. Thus, these bags are sold in containers that form stacks of the baggies and do not lend themselves to ready disposition and storage on a roll where they can be dispensed one at a time. The essential problem confronted in making bags of this type is the face that the slit which defines the opening allowing access to the interior of the bag, since it is coextensive with the width of the bag, does not allow sufficient purchase area of the bag by machinery for an endless web or sheet of indeterminate length to be drawn through processing stations and thereafter wound on a spool for subsequent dispensing. Thus conventional Baggies TM are stacked and not found on a spool.

Other types of bags are commercially known which are formed from tubular stock sealed at one end and allowed to remain open at the other end and perforations provided at both ends, the entire series of bags disposed on a roll so that they can be dispensed by tearing one at a time. Alternatively, rather than tubular stock, the bags of this nature can also be formed from sealing two sheets of material together along the edges. These types of bags are characterized as being extremely difficult to separate the two plys to gain access to the interior, and further no flap and associated lip is provided therewith for folding over the lip with respect to the flap so as to reliably contain that which is disposed within the interior of the bag. These bags are sealed with a twist tie or taped shut, heat sealed, glued, stapled or sewn.

Various other prior art attempts at providing an enclosure which serves the needs of society while lending themselves to mass production techniques are reflected in the following list of patents:

| Patent Number | Inventor | Issue Date |
|---|---|---|
| 2,146,308 | Maxfield | Feb. 7, 1939 |
| 2,562,389 | Piazze | July 31, 1951 |
| 2,643,049 | Bartelt | June 23, 1953 |
| 2,921,731 | Volckening, et al. | Jan. 19, 1960 |
| 2,929,180 | Abrams, et al. | March 22, 1960 |
| 3,105,417 | Hammer | Oct. 1, 1963 |

-continued

| Patent Number | Inventor | Issue Date |
|---|---|---|
| 3,117,712 | Kugler | Jan. 14, 1964 |
| 3,151,354 | Boggs | Oct. 6, 1964 |
| 3,254,828 | Lerner | June 7, 1966 |
| 3,469,769 | Guenther | Sept. 30, 1969 |
| 3,979,050 | Cilia | Sept. 7, 1976 |
| 4,344,557 | Lerner | Aug. 17, 1982 |
| 4,401,213 | Lerner | Aug. 30, 1983 |

The patents to Lerner '828 is interesting since he teaches the use of flexible container strips in which first and second plys are intermittently sealed and one of the plys is provided with an elongate slit transverse to the direction of sheet fabrication travel and a plurality of perforations provided allow dissociation of adjacent containers formed thereby. Appropriate air jets are utilized to separate the two plys to allow admission of articles within the thus formed enclosure. A cursory analysis of this teaching makes it manifest that no planar lip of comparable configuration to that which is disclosed in the instant application is to be found, and therefore the resultant structure does not lend itself to the type of utilization which has made Baggies TM so popular. Moreover, this citation is silent on the means by which the ply having an opening slit that extends the entire width of the thus formed bag is advanced before the sheets are joined together. That is to say, the slits formed as the opening preclude the advancement of that ply of material downstream due to the discontinuous nature of that ply.

The remaining citations which show the state of the art further diverge from that which is defined as the nexus of the invention continued in the ensuing claims.

With greater specificity, however, the instant application is distinguished over the known prior art in that an apparatus, method therefor and resultant articles have been disclosed which allow for the formation of a plurality of bags embodied as a linear series, each of the thus formed bags defining enclosures having openings which by virtue of the construction technique are capable of extending the entire width of the bag transverse to the direction of travel of the series, the series of bags connected in end-to-end relationship with the bottom and top of bag forming the areas of adjoinment with adjacent bags, so that the bags when formed can be stored on a roll. The bags themselves include a turned over flap portion on a one ply which is adapted to communicate with a lip formed from another ply of the bag. Optionally, the bag may include during its formative steps a pleat or gusset, and one embodiment orients the reinforcing flap which was adjacent the opening and places it at the bottom of the bag to provide reinforcement at the bottom. The apparatus and method also lend itself to forming a bag having first and second separate interiors formed from sealing edges together three plys of material so that an axis of symmetry is provided by the medial ply. Optional slots fo facilitate carrying the tote bag are also incorporated on all three sheets.

To effect formation of the bags, an apparatus and method for manipulation of the apparatus includes providing at least two rolls of sheet material, forming flaps in one of the sheets by cutting a three sided flap, tacking the thus formed flaps against the same ply of sheet material, sealing the two plys of material along side edges thereof so that an enclosure is formed, optionally forming gussets along side panels of the bag, and end sealing adjacent bags including providing perforations to allow disassociation of adjacent bags. When a dual enclosure system is provided, a third roll of sheet material is provided which enjoys the flap forming and flap tacking steps, the roll provided without flaps serves as the medial substrate between the two flap including sheets, which are all thereafter cojoined along outboard edges. In a preferred form of the invention, the width sheet material is a whole number multiple N of a single bag's width so that if the width of the bag is W, and the width of the sheet material is NW, N rolls are formed at the output station by providing a final serving step between adjacent bags widthwise, to benefit from the economies of scale in an extra wide operation. More importantly, the flaps formed are staggered with respect to laterally adjacent bags that are being formed so that a serpentine continuous path of sheet material exists providing a tractive surface allowing advancement of the sheet goods even though the slit defining the opening of the bag is substantially the width of the finished bag. That is, there is a continuum of material that weaves around the tacked back flaps in a serpentine fashion so that there is sufficient sheet material to drivingly support bags having openings the width of which is substantially equivalent to the width of the bag.

Optional flaps may be cut out and removed completely, or left untacked.

SUMMARY AND OBJECTS OF THE INVENTION

Accordingly, this invention has as its objective the provision of a new and novel bag forming apparatus, method and the article formed thereby.

A further object of this invention contemplates providing an entity as defined hereinabove where bags having downwardly turned flaps and associated lips adapted to cooperate with the flaps are disposed on a roll provided with perforations between adjacent bags for easy dissociation, the lip and the flap together providing a facile tactile means for dissociating the two plys that form the bag allowing access to the interior of the thus formed enclosure.

A further object of this invention contemplates providing a mass produced entity as characterized above which includes plural rolls of bags, where each bag's opening is substantially the width of the bag itself.

A further object of this invention contemplates providing a device as characterized above in which a plurality of bags are simultaneously formed which is a whole number multiple of a single bag's width and defines the total width dimension of the sheet material used which is subsequently divided by the whole number integer to form simultaneously a plurality of such rolls with the openings transverse to the direction of roll travel.

A further object of this invention contemplates providing a device as characterized above in which the flaps formed for each bag are staggered with respect to laterally adjacent other bag flaps so that a serpentine continuum of sheet material is provided.

A further object of this invention contemplates providing a device as characterized above which is durable in construction, relatively easy to manufacture and lends itself to mass production techniques.

A further object of this invention contemplates providing an entity as characterized above which is durable in construction, long lasting and safe to use.

A further object of this invention contemplates providing a three sheet variation of a single enclosure bag in which at least two enclosures are provided with an axis of symmetry along a medial sheet thereof.

A further object of this invention contemplates providing a device as characterized above in which a reinforced area is provided preferably at the bottom of the enclosure for additional structural support.

A further object of this invention contemplates providing a device as characterized above wherein a handle is provided on the foldover and lip portion of the bag for facilitating transport in use and operation.

A further object contemplates providing a bag formed from three sheets which, due to its construction, includes a handle adapted to carry heavy loads such as a sixth of a barrel—a common volume in grocery store bags for example.

These and other objects will be made manifest considering the following detailed specifications when taken in conjunction with the appended drawing figures.

BRIEF DESCRIPTION OF THE DRAWING FIGURES

BRIEF DESCRIPTION OF THE PREFERRED EMBODIMENT

Figure 1:
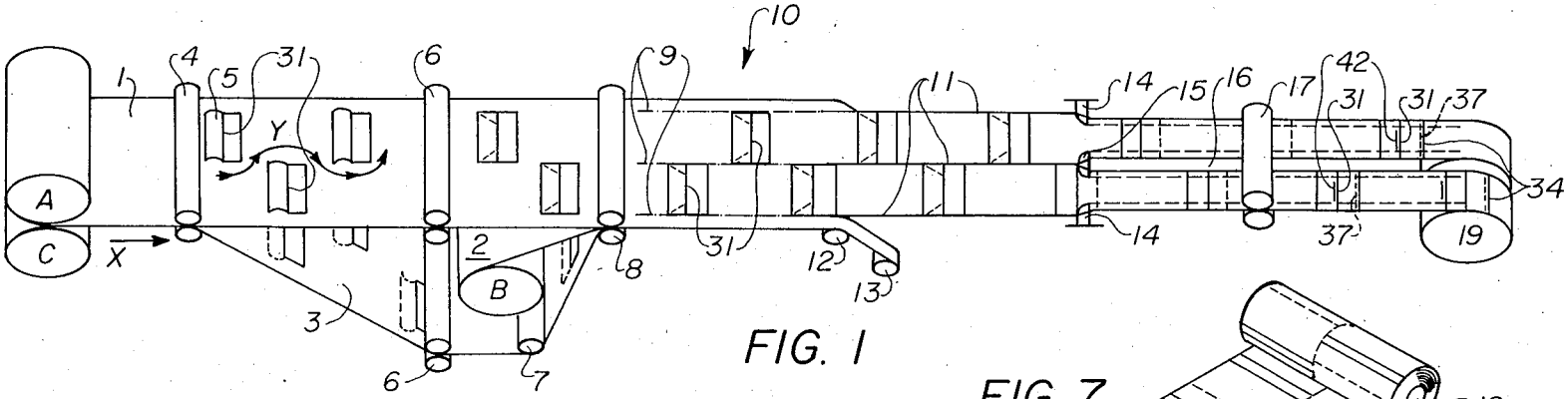
FIG. 1 is a perspective view of the apparatus according to the present invention.

Referring to the drawings now, wherein like reference numerals refer to like parts throughout the various drawing figures, reference numeral 10 is directed to the bag forming apparatus according to the present invention.

In its most elemental form, the bag forming machine includes two storage supply rollers A and B which after preliminary operations on the sheet goods contained in roll A are joined together so as to form a bag sealed on side edges as will be explained. Each roll contains an indeterminate length of sheet material which in a preferred form of the invention is a thermoplastic material. A second form of the invention includes a third roll C which provides a three sheet bag to be described hereinafter.

In any event, roll A dispenses an elongate sheet of material 1 between a pair of rollers 4 which has disposed thereon at least one cutting die and preferably two or more spaced from each other and 180° out of phase on the roller so that flaps 5 are cut into the sheet material 1. As shown in the drawing figures, the flaps are cut on three sides leaving one edge unsevered which defines the leading edge of the opening for the bag when assembled. When the sheet material 1 advances in the direction of the arrow X, the flaps can be formed such that the leading edge of the opening travels before the thus formed flap 5. In this event, the flap trails behind the leading edge and subsequent processing can occur without the use of air jets for directing the FIG. 1 flap. FIG. 1 shows this operation where the open end of the bag enters the roll first. Alternatively, however, if the cut is made such that the flap extends forwardly, at a tacking station 6, air jets are provided immediately preceding the tacking station to direct the flaps so that the folded over or doubled over portion is flat and smooth and in tangental registry with the web of sheet material 1 so that the tacking operation can occur without wrinkles being formed in the flap. When using air jets to direct the flaps forward, the cutting dies for the flaps must first be reversed. In this operation, the bottom seal and tearoff perforations are reversed and placed on the opposite end of the bag, whereby the closed end of the bag would enter the finished roll first. Downstream from the tacking station 6, the tacked flaps are depicted as in FIG. 1. The tacking can be parallel side edges of the bag or angled inwardly.

Station 8 provides an area where rollers combined with a thermal element join together two sheets of material, the sheet 2 coming from roll B and the sheet 1 coming from roll A. As shown in the drawing, they are slit sealed at least in N+1 places as shown by the slit seals 9 where N equals the number of rolls ultimately formed. Thus, the outboard most portions of the bags to be formed are sealed, and since in the illustrative example the sheet is a whole number integer multiple (N=2) of a single bag's width, a central slit seal 9 is also provided. Note that the leading edge of the flap opening is substantially coextensive with the width of the bag to the slit sealed edges Immediately downstream from the slit sealing operation, a plurality of spreader blades are provided and in the illustrative embodiment, N+1 or three such spreader blades 11 serve to spread excess material from outboard edges of the two ply laminate. The marginal portions of the outboard edges of the sheet material pass over a roller 12 and are stored on a further roller 13 for either subsequent use or discarding, depending upon its relative dimension.

Further downstream from the slit sealing operation, another pair of rollers 17 are provided which periodically provide a perforated line 37 transverse to the longitudinal axis of the direction of travel X of the sheet material so that a weakened area exists and a series of bags subsequently wound on storage rollers 19 have been provided, each one capable of dissociation from an immediately adjacent bag due to the weakened area provided by the perforation. Closer analysis at the perforating line 37 shows that the station 17 included, in addition to the perforation, a sealing line between the score line and the bag opening so that its totality, seams are provided on lateral edges of the bag and along the bottom walls thereof with the two sheet material thus forming an enclosure having a front wall, a back wall, and three sealed edges. The flap which is turned over on an outer face of one bag ply 1 includes a leading edge 31 so that access to the interior of the bag has been provided, and in view of the fact that a portion of the sheet material has been folded over, the material 2 emanating from roller B has an excess lip portion which has not been folded over so that the lip formed extends beyond the leading edge of the flap and can be folded over to seal the contents placed within the enclosure of the bag or with slit 42 for carrying.

Figure 7:
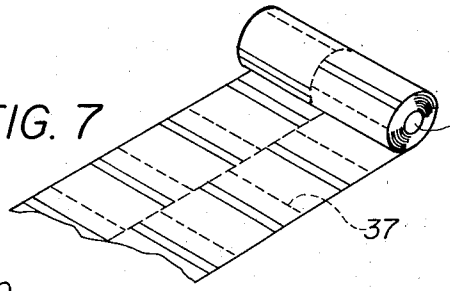
FIG. 7 shows a perspective view of a two-roll embodiment of the invention having staggered perforations.

It is important to note that the spacing of the adjacent cuts which form the flaps are periodically out of phase with respect to the entire width of the sheet material so that as shown diagrammatically between stations 4 and 6, a non-interrupted length of sheet material Y has been provided which is serpentine in configuration FIG. 7 shows two rolls of bags created side-by-side by the method of laterally offsetting flaps and lines of perforations between bags. Roller 19 has two adjacent rolls of bags wherein perforations 37 are staggered. Station 4 provides this periodic flap cutting by having laterally offset cutting dies thereon. The line of force generated by pulling at successive roller stations to advance the sheet material now has adequate material to drive the indeterminate length of sheet material by using the serpentine sheet material whose line of force parallels the arrow Y. This important contribution allows the opening to the interior of the bag to run the entire width of the bag. The spacing of the flaps allows sheet advancement without wrinkling or sheet distortion and uniform pulling.

A further embodiment of the invention includes providing a third roll C of sheet material 3 which passes between the flap forming station cutting rollers 4 forming flaps similar to those on sheet 1 directed ultimately below the second roller B material 2. A flap tacking station 6 is provided therebelow and a redirecting roller 7 downstream the second roll B directs the third roll 3 of material back up to the sealing station 8 allowing seams 9 to be formed thereon so that a three sheet structure has been provided whose configuration will be discussed hereinafter but has two downwardly extending flaps 5, two enclosures, all of which are separated by the medial sheet 2.

An additional feature of the invention includes the optional provision of a gusset or pleat forming station 14, 15 which includes a first pair of forming wings 14 interposed between the cutting station and the end of the bag sealing and perforation station 17 adapted to modify side edges of the bags, these forming wings being provided to instill in the polyethylene or whatever sheet material is being used a memory and crease which ultimately allows gussets to become a permanent fixture in the bag thus formed. An additional double headed forming wing 15 is provided between each two adjacent bags being formed and is interposed between the outboard anvils 14. Thus two outboard forming wings 14 are provided and N−1 inboard forming wings 15 are required.

The illustrative embodiment reflects rolls of material having a width dimension substantially twice the width of the bags to be formed so that the serpentine path Y is provided with adequate material whereby pulling on the rollers does not cause distortion. Furthermore, since the flaps associated with the openings can run the entire width of the bag, a minimal amount of material is gathered on the storage rollers 13 which may be waste material in any event. It is to be noted that in conventional bags being formed, this marginal portion carried on the storage roller 13 would have to be substantially greater to drive the sheet material and a problem in warping or wrinkling of the bag would still have been experienced in prior art devices. While for illustrative purposes, the whole number multiple in the illustrative embodiment is 2, it should be clear that the width of these rolls of sheet material can be any dimension within the limits of manufacturing facility and commercial availability.

It is appropriate now to discuss the ultimate configuration of some bags which can be formed from the apparatus disclosed hereinabove merely as illustrations.

FIGS. 2 through 6 reflect end results caused by manipulation of the sheet material to ultimately form bags. Those bags illustrated which are two sheets are formed from the first discussed operation with respect to rolls A and B, whereas the three sheet bag is derived from the three roll embodiment. Clearly those two sheet examples which are shown here can also have a mirror image as suggested in FIG. 2 for the three sheet embodiment so that first and second enclosures are provided allowing disparate matter to be contained within each enclosure pocket. More importantly, the primary function of the third sheet is to make it possible to have flaps on both outside sheets (1) and (3), with sheet 2 doing the pulling through the machine. Conversely, the three sheet embodiments could be two sheets or have disparate outer sheets, without symmetry.

Figure 6:
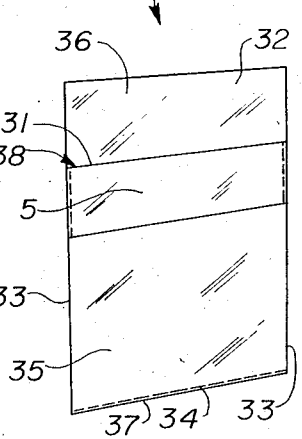
FIG. 6 shows a fifth form of bag.

In its most elemental form, the bag derived from the first discussed apparatus of rolls A and B is shown in FIG. 6 and includes a front panel 35 formed from the sheet material 1 emanating from roll A, a topmost edge 31 thereof formed by the folding and cutting operation wherein the flap 5 has been formed, a second sheet of material 32 derived from the second sheet of indeterminate material 2 underlying the first sheet 35 having a topmost portion defining a lip 36. The enclosure is made complete at station 8 by slit seals 33 and 34, the slit seals 33 running along the longitudinal extent on outboard edges of the bag, and the bottom seal 34 sealing the bottom of the two sheets completing the bag made at station 17. The weakened line 37 is shown severed from the chain of bags so that this bag is ready for use.

Figure 3:
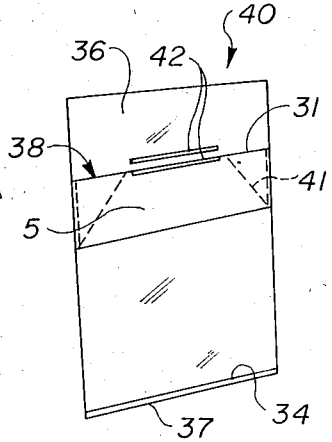
FIG. 3 shows a second form of bag.

FIG. 3 is similar to FIG. 6 with two notable exceptions, and those areas of similarity bear like reference numerals. In FIG. 3, the bag 40 includes a seam where the flap 5 was tacked back which was angled upwardly and inwardly toward the lip portion of the second sheet, so that this upwardly and inwardly angled seam 41 coupled with the leading edge 31 of the opening 38 provides a trapezoidal free space between the flap 5 and the sheet goods 35. Another notable distinction is a slot 42 provided in the leading edge 31 of the flap 5 and carried on the second ply on the lip 36 of the bag 40, the slot 42 not coextensive with the entire width of the sheet material. The slit 42 serves as a grasping handle and can be placed on the sheet material 1-2-3 at station 8 or 17 if desired since corresponding flap material 1 and 3 has been folded over previously.

Figure 5:
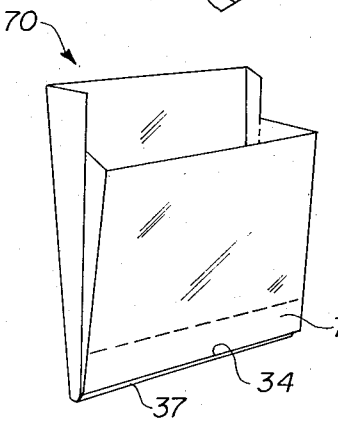
FIG. 5 shows a fourth form of bag.
Figure 4:
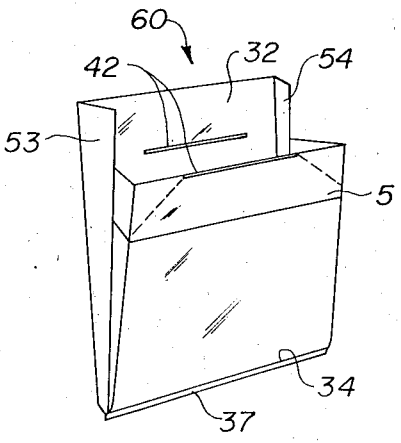
FIG. 4 shows a third form of bag.
Figure 2:
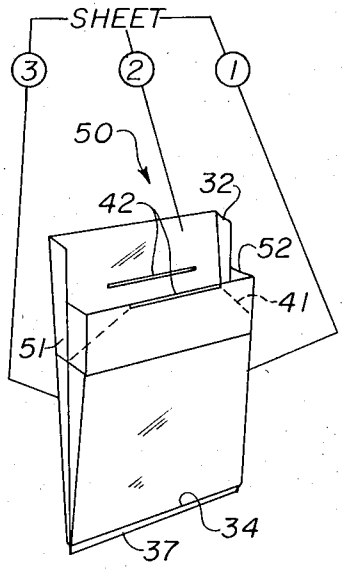
FIG. 2 shows one bag formed by the apparatus and method delineated in FIG. 1.

The remaining embodiments 50 of FIG. 2, 60 of FIG. 4 and 70 of FIG. 5 all have been formed relying on the optional gusset forming step shown in FIG. 1 at forming wing station 14 and 15.

Thus, FIG. 2 reflects a bag 50 formed from three sheet material relying on rolls A, B and C which has attributes of that which is shown in FIG. 6 including the angle tacking 41, the hand slit 42 but also gusseted side walls 51 and 52. In addition, the bag of FIG. 2 has an axis of symmetry defined by the sheet 32 emanating from roll B. A second enclosure is thus formed on another face of sheet 32 so that two separate enclosures are provided.

FIG. 4 shows a bag made from sheet 1 and 2 which is similar to that which is shown in FIG. 3 in that it includes the hand slots 42 but has gussets 53 and 54 which provide a V-shaped pleat, allowing them to fold upon themselves for compactness in storage. That is to say, the FIG. 2 gussets while being V-shaped find their axis of symmetry (pleat line) coincident with the middle panel 32. In this instance the gusset is on two sides of the panels.

FIG. 5 is a view similar to FIG. 4 but has deleted the hand carrying slot 42 and is absent the flap 5. Here, the synchronization of the flap forming station 4 is such that the doubled over portion and therefore the flap 75 occurs at the bottom of the bag in which event the bag thus defined has a reinforced bottom. The flap is not tacked back onto the sheet material 1, rather the tacking station is downstream of the confluence with roller B sheet material 2 so that the tacking that occurs is conceivably at station 17 where the heat seal causes the flap 75 to be heat sealed between sheets 1 and 2 rather than back upon itself.

In any event, it should be apparent that the different features shown in drawing FIGS. 2 through 6 are merely illustrative of different features that can be incorporated in the bags in that various and sundry permutations and combinations of the features shown can be incorporated in a composite bag ranging from the features of the simplest version to the most complex.

More specifically, that methodology may be characterized in provision of a plurality of bags each having an opening allowing access to an interior of each bag, with the opening running substantially the entire width of the bag. When the bag is formed the opening formed is transverse to the longitudinal axis or direction of travel of the sheet material forming the bags. The plurality of bags are each formed of two opposing panels with the opening consisting of the absence of bag material on one panel which when folded over may form a flap adjacent the opening allowing access to the interior of the bag. In another form of the invention, the flap serves to reinforce the bottom portion of the bag. Alternatively, using 3 sheets, two flaps may be provided which provide not only the doubled over and reinforced bag bottom but also the turned over portion adjacent the opening. In any event, a lip is formed on the other panel defined by that amount of material which was not folded over with respect the first panel, and each panel is thereafter sealed to each other along side edges. The flaps are tacked preceeding the edge joining operation. The bags are slit sealed at their width, gussets are formed if desired, and the end of the bag is sealed along with perforations to allow dissociation of the bags from a serial array. Another method contemplates providing a third roll which receives a flap at the same point as the first roll such that when the second sheet of material is interposed between the first and third sheets a mirror image is formed with the bag having two enclosures. By providing the cuts forming the flaps 180° out of phase and laterally offset with respect to the rollers based on bag width, a serpentine path of material and an associated line of force Y which is also serpentine allows the length of sheet material to be advanced without distortion or wrinkling whereby marginal strips or material which are ultimately severed after the sealing operation can be kept to a minimum since these marginal strips are frequently waste material. As discussed hereinabove, subseqent to the joining of the sheets, whether two or three sheets, along outboard edges thereof, the bags are severed so that the excess material is provided in a width which is a whole number multiplier of the ultimate width of the bag, a plurality of independent rolls are thus formed at the severing station, all of which may be seprately wound and stored. The gusset operation can be interposed between the severing operation and the bag bottom sealing and perforation operation for the attendant advantages.

Moreover, having thus described the invention, it should be apparent that numerous structural modifications are contemplated as being a part of this invention as set forth hereinabove and as defined hereinbelow by the claims.

What is claimed is:

1. A plurality of article retaining bags on a roll each bag comprising an interior an opening allowing access to the interior, first and second opposing panels, side seal joining at least a portion of the opposing panels at the bottom of each bag, a lip extending from the opening formed from excess material on the front panel, a flap which is a portion of the second panel doubled over itself and tacked in proximity to the side seals adjacent to the opening to the interior, said plurality of bags being oriented as an uninterrupted joined series of bags of indeterminate length, the openings being transverse to the length of said series, and the plurality of bags being adapted to storage in rolls wherein said roll of bags includes a series of bags comprised of at least two rows of bags, side by side wherein said rows comprise bags which are separable, one from another, by perforations between the bottm seal of one bag and the lip of the preceding bag and wherein said rows are staggered such that the perforations do not extend entirely across the rows.

* * * * *